US007864072B2

(12) United States Patent
Basson et al.

(10) Patent No.: US 7,864,072 B2
(45) Date of Patent: Jan. 4, 2011

(54) SYSTEM AND METHOD FOR AUTOMATICALLY ADJUSTING TRAFFIC LIGHT

(75) Inventors: Sara H. Basson, White Plains, NY (US); Wilfredo Ferre, Le Mesnil le Roi (FR); Julien Ghez, Malakoff (FR); Dimitri Kanevsky, Ossining, NY (US); Frances W. West, Newton, MA (US)

(73) Assignee: International Business Machines Corporation, Armonk, NY (US)

( * ) Notice: Subject to any disclaimer, the term of this patent is extended or adjusted under 35 U.S.C. 154(b) by 262 days.

(21) Appl. No.: 12/140,543

(22) Filed: Jun. 17, 2008

(65) Prior Publication Data

US 2009/0146841 A1 Jun. 11, 2009

(30) Foreign Application Priority Data

Dec. 11, 2007 (EP) ..... 07301541

(51) Int. Cl.
*G08G 1/07* (2006.01)

(52) U.S. Cl. ..... 340/925; 340/903; 340/905; 340/907; 340/917; 340/933; 340/944; 701/25; 701/41; 701/43

(58) Field of Classification Search ..... 340/925, 340/903, 905, 907, 917, 933, 936, 944; 701/25, 701/41, 43

See application file for complete search history.

(56) References Cited

U.S. PATENT DOCUMENTS

| | | | | |
|---|---|---|---|---|
| 6,421,453 | B1 | 7/2002 | Kanevsky et al. | |
| 6,724,320 | B2 | 4/2004 | Basson et al. | |
| 6,792,339 | B2 | 9/2004 | Basson et al. | |
| 7,092,566 | B2 | 8/2006 | Krumm et al. | |
| 7,706,965 | B2 * | 4/2010 | Downs et al. | 701/117 |
| 2004/0128389 | A1 | 7/2004 | Kopchik | |
| 2005/0270175 | A1 * | 12/2005 | Peddie et al. | 340/907 |
| 2006/0181433 | A1 * | 8/2006 | Wolterman | 340/917 |
| 2008/0004761 | A1 * | 1/2008 | Yamada | 701/25 |

FOREIGN PATENT DOCUMENTS

| | | | |
|---|---|---|---|
| GB | 2 381 922 | A | 5/2003 |
| WO | WO 03/105406 | A1 | 12/2003 |
| WO | WO 2004/036447 | A1 | 4/2004 |

* cited by examiner

*Primary Examiner*—Tai T Nguyen
(74) *Attorney, Agent, or Firm*—John A. Jordan

(57) ABSTRACT

A system, program product and method for automatically adjusting the traffic light of a traffic light controlled intersection. Personal data relative to a pedestrian cross walking the intersection, including walking speed, and the current speed of a vehicle approaching the intersection are simultaneously acquired. Both the personal data and the vehicle current speed are processed to generate cross walk control signals, such as indicators of risk of collision between vehicle and pedestrian. Where the risk warrants action, the "stop" condition of the traffic light is enable to warn the vehicle to stop. Traffic control signals are also generated to control the duration of the "walk" condition for slow moving pedestrians.

20 Claims, 6 Drawing Sheets

SYSTEM AND METHOD FOR AUTOMATICALLY ADJUSTING TRAFFIC LIGHT

BACKGROUND OF THE INVENTION

1. Field of the Invention

The present invention relates generally to the field of traffic regulation systems and, more particularly, to a system and method for adapting the traffic light regulation to individual walk speed.

2. Background and Related Art

The management of traffic regulation systems in urban areas, and especially in the crosswalk structures, necessitates the consideration of the speed of motion or walking speed of a pedestrian crossing a roadway.

The role of a traffic control and regulation system is to ensure that road users, and in particular vehicle drivers and pedestrians, can safely move on their infrastructures by reducing the risk of accident, such as through collision.

In developed countries, there exists a number of concepts directed to assisting pedestrians crossing a road at designated points, such as, intersections. These intersections are equipped with safety systems that can be seen by both the drivers and pedestrians, but most of such systems do not allow slower moving pedestrians, like the elderly or people with disabilities, to safely cross the road given the flow of traffic. One well known system allows the pedestrian to change the traffic light for on-coming vehicles from green to red by pressing a button at the crossroad thus creating a "walk" condition. However, there is no way to automatically control the duration of the red traffic light condition once the pedestrian is in the process of crossing the road.

It is known that the aging process causes decline in both musculoskeletal and physical function. For example, common hip and leg impairments, such as arthritis, can limit walking speed comfort and distance. Loss of limb strength, flexibility, sensitivity or range of motion, and reduced ability to rotate the head and neck all can make crossing a road more challenging.

Several research organizations have conducted studies on the safety of the current crossing infrastructures. One such organization is the National Highway Traffic Safety Administration (NHTSA). Such research has produced data on the safety of crossing infrastructures. Data from NHTSA has shown that walkers over the age of 70 have the highest fatality rate of any pedestrians at intersections. NHTSA data has also shown that many older pedestrians walk more slowly than the Federal Highway Administration estimate, which is of 1.2 meters per second. This estimated time is used for regulating the duration of the "flashing walk/don't walk" signals. Consequently, NHTSA recommends the use of slower walking speeds in setting traffic signal times in areas where older "pedestrians are likely to be walking".

According to this recommendation of NHSTA, a walking speed of 0.9 meters per second is sufficient to cover nearly all walkers, including the elderly people and people with disabilities. It is understood that NHTSA plans to further review research on this matter and may make recommendations to revise pedestrian signal timing to allow for slower walking speeds. However, not every pedestrian requires accommodation for such slower walking speeds.

Accordingly, there is a need for developing a tool to assist slow moving people when crossing a road. Such a tool should consider both the speed of pedestrians and the speed of vehicles at intersections.

The difficulty with present systems is that the majority of slow moving pedestrian have to self-manage their situation when crossing roads. However, it is clear that self-management is not effective in preventing injuries and fatalities to pedestrians.

In summary, the current traffic regulation systems present several drawbacks for slower moving people. For example, although current systems are appropriate for an overall or general population, it is not appropriate for slower moving people. In this regard, the current system is based on pedestrian speed that is the norm, and does not consider the speed as relates to each individual pedestrian. Moreover, the current system is not flexible in that it does not allow variation beyond the norm of the time duration of the "flashing walk/don't walks" signal. That is so because there is no interactive mechanism to facilitate communication of information as to the presence of a slower moving pedestrian and then adjust the traffic control systems accordingly.

SUMMARY OF THE PRESENT INVENTION

Therefore, it is an object of the present invention to provide a system and a method which overcome the above shortcomings in traffic control systems.

In accordance with the present invention there is provided an auto-detection motion solution method and apparatus oriented to urban areas for safely managing crossing structures.

The present invention manages the traffic lights duration allowing slow moving pedestrians to safely cross intersections by automatically adjusting the "walk" state cycle time in accordance with the crossroad environment conditions.

Thus, it is another object of the present invention to provide a method and system by which allows slow moving pedestrians to safely cross a road or street.

The automatic speed detection process and system of the present invention acts to detect pedestrians that move at a pace different from the "norm", and then acts to adjust the time duration of the "walk" state required for safe crossing.

A further object of the present invention is to provide an automatic speed detection arrangement based on biometrics technology used to authenticate the exact speed of motion or walking speed related to each pedestrian.

It is yet another object of the present invention to provide an automatic speed detection method and system having additional recognition features including some stored preset pedestrian information, such as, user identification and user preferences, readable by using individual smart card technology.

It is still another object of the present invention to make available to each pedestrian the ability to enable the disclosed method and system so as to establish the desired interaction corresponding to their preferences using wireless network technology.

According to the invention, there is provided a method and system to assist slow moving people, after being authenticated at crossing structures, as described in the appended claims.

In one embodiment, a method comprising: obtaining personal data from a pedestrian crossing an intersection, said personal date including at least the walking speed of said pedestrian; obtaining the current speed of at least one vehicle approaching the intersection; processing said personal data and the current speed of said at least one vehicle to create at least one cross walk indicator; and adjusting a traffic light according to the value of the at least one cross walk indicator. In addition, there is provided a computer program product for controlling a traffic light, said computer program product comprising a computer readable storage medium having computer readable program code embodied therewith to carry out program instructions for generating traffic control instructions.

In a further embodiment, a system, comprising: detection apparatus for obtaining personal data relative to at least one pedestrian crossing an intersection, said personal data including at least the walking speed of said pedestrian; detection apparatus for obtaining the current speed of at least one vehicle approaching said intersection; a data processing apparatus for processing said personal data relative to the walking speed of said at least one pedestrian crossing said intersection and the current vehicle speed of at least one vehicle approaching said intersection to generate traffic control signals; and a traffic light regulator for sending said traffic control signals to a traffic light to control vehicle and pedestrian traffic in accordance with pedestrian and vehicle traffic speed.

Further aspects of the invention are provided by the further embodiments described in the appended description and claims.

BRIEF DESCRIPTION OF THE DRAWINGS

The above and other items, features and advantages of the invention will be better understood by reading the following more particular description of the invention in conjunction with the accompanying drawings wherein.

DETAILED DESCRIPTION

Embodiments of the invention as described herein are by way of example with reference to the accompanying figures and drawings.

Figure 1:
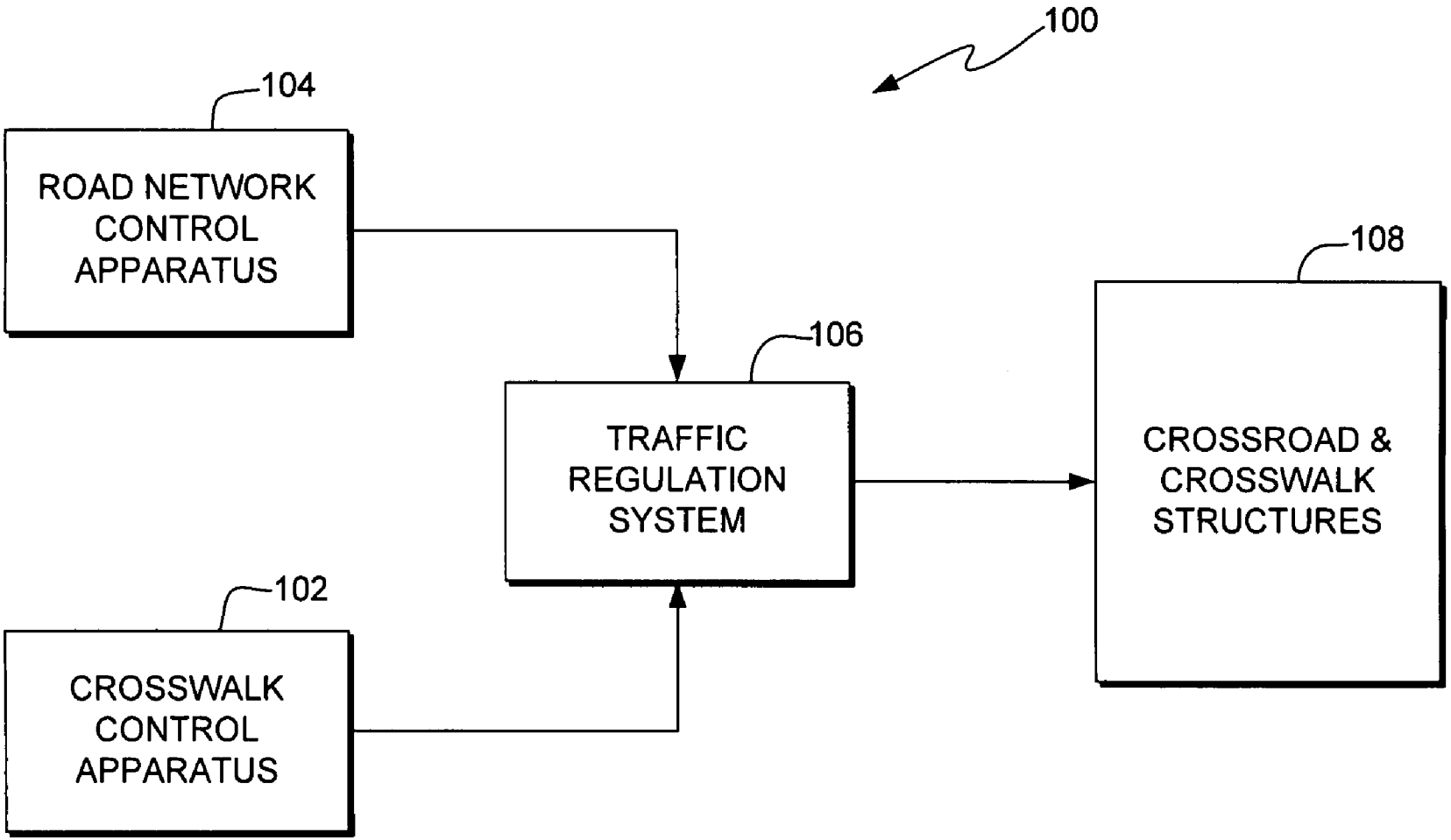
FIG. 1 shows a global block diagram of the system of the present invention.

As shown in FIG. 1, an overview of the system of the present invention is shown as traffic regulation system 100 for controlling the traffic light duration for pedestrians cross walking a road or street, in accordance with the mobility of the individual pedestrian.

System 100 is designed to regulate crossroad traffic by detecting the walking speed of pedestrians that are about to engage the crosswalk. At the same time, the speed of oncoming vehicles that are within the crosswalk field is determined.

The system comprises Crosswalk Control Apparatus 102 for measuring and controlling pedestrian walking speed. Road Network Control Apparatus 104, for measuring and controlling vehicle speed and Traffic Regulation System 106 that regulates, in real time, control signals to Crossroad and Crosswalk Structures 108. The Crossroad and Crosswalk structures are the physical structures at the intersection including pedestrian and vehicle traffic control signals or lights.

Figure 2:
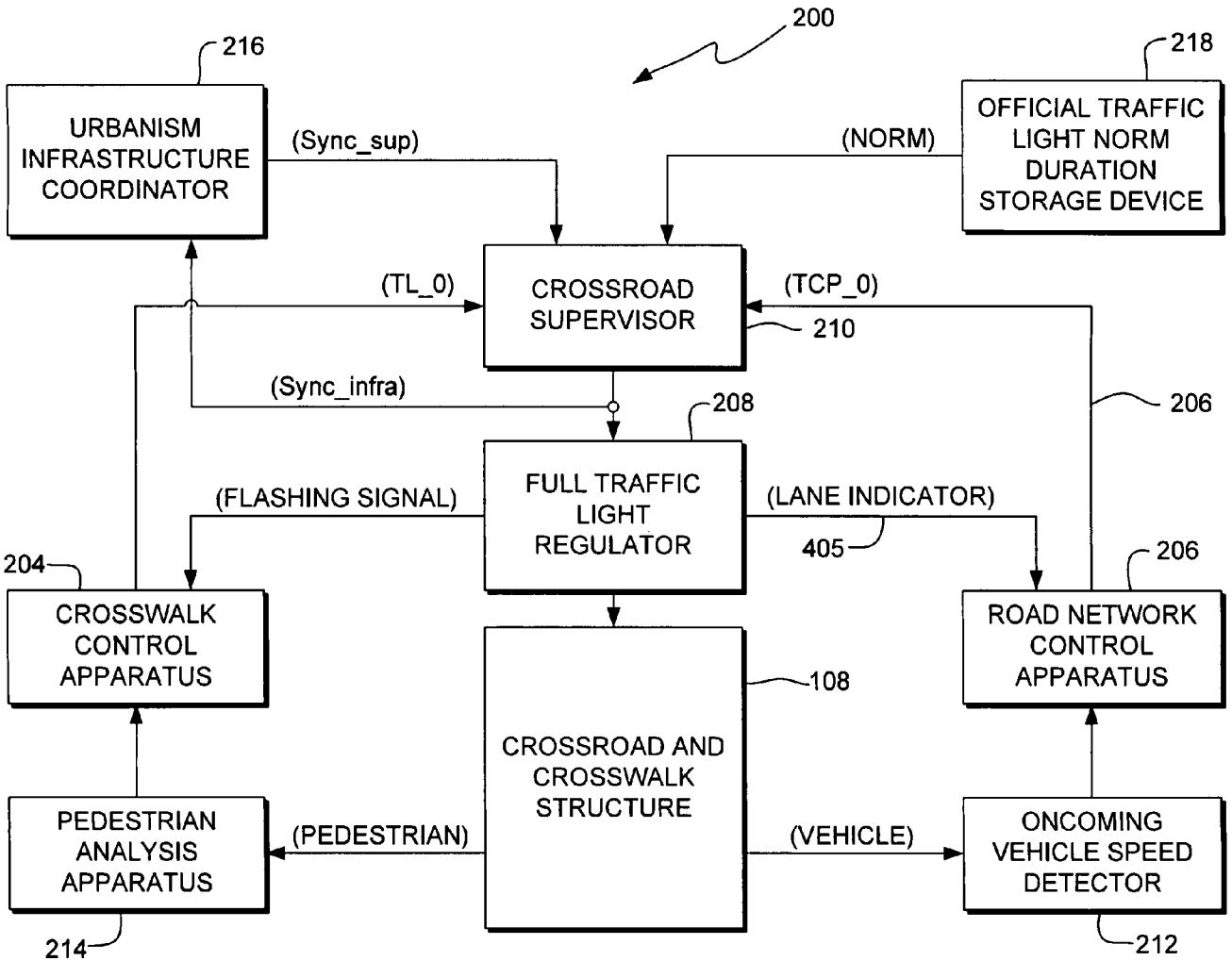
FIG. 2 details a preferred embodiment of the automatic speed detection system shown in FIG. 1.

Referring now to FIG. 2, there is shown a more detailed system 200 for adjusting the timing and control of traffic control signals or lights. In this regard, like reference characters is in FIGS. 1 and 2 are used to show like objects. Crossroad Supervisor 210, Full Traffic Light Regulator 208, Official Traffic Light Norm Duration Storage Device 218 and Urbanism Infrastructure Coordinator 216 in FIG. 2 are included in Traffic Regulation System 106 in FIG. 1. Pedestrian Analysis Apparatus 214 provides pedestrian identification input to Crosswalk Control Apparatus 204, such as, slow pedestrian speed identification, a crosswalk request via push button or wireless smart card input.

Road Network Control Apparatus 206 evaluates the speed of vehicles using Oncoming Vehicle Speed Detector 212 input when any oncoming car or vehicle is in the field of Crossroad and Crosswalk Structure 108, particularly in case the oncoming vehicle approaches the adjacent corner of the crosswalk section.

The terms car, automobile, truck or vehicle may be used interchangeably to generally refer to a vehicle that travels on a road network.

The term crosswalk generally refers to the pedestrian identified pathway at an intersection, as depicted by Crossroad and Crosswalk Structure 202 in FIGS. 1 and 2. However, a crosswalk may exist at other points on busy roads or streets to allow safe pedestrian crossing. In the present description, the configuration of the Crossroad and Crosswalk Structure 202 may include one or several bidirectional lanes.

Full Traffic Light Regulator 208 interfaces and manages, in real time, Crossroad and Crosswalk Structure 202 using the data provided by the Crossroad Supervisor 210. Based on Crossroad Supervisor decisions, Full Traffic Light Regulator 208 enables, or not, the "walk/don't walk" signal (not shown here) via a "flashing signal" command to be applied to Crosswalk Control Apparatus 204.

Similarly, based on Crossroad Supervisor 210 decisions, Full Traffic Light Regulator 208 enables, or not, the adjacent lane "stop" indicator via a "lane indicator" command to be applied to Road Network Control Apparatus 206.

Crossroad Supervisor 210 receives data (Traffic Light_O 'TL_O') from Crosswalk Control Apparatus 204 and data (Traffic Control Panel_O 'TCP_O') from the Road Network Control Apparatus 206. In addition, referential data (norm) is provided to Crossroad Supervisor 210 by Official Traffic Light Norm Duration Storage Device 218. All the aforementioned data, in combination with the synchronization data signal ("sync_sup" signal), received from Urbanism Infrastructure Coordinator 216 is processed by Full Traffic Light Regulator 208 taking into consideration both the pedestrian walking speed and the vehicle speed.

Crossroad Supervisor 210 monitors and processes, in real time, the time adjustment required in controlling crossroad traffic patterns when a slow moving pedestrian is in the crosswalk field. To avoid any risk of collision between the pedestrian and the vehicle coming from the adjacent corner, an adjacent "lane stop road indicator" (not shown in FIG. 2) is implemented in the lane closest to the crosswalk. The "adjacent lane stop road indicator" is enabled by the "lane indicator" command given by Full Traffic Light Regulator 208 in FIG. 2. The "lane indicator" command is turned "ON" to warn the driver when the crosswalk situation presents a risk of collision and will stay "ON" until the pedestrian crossing street completion occurs.

A series of Oncoming Vehicles Speed Detectors (only one shown at 212) are mounted all along the road network to capture the speed of the vehicles that are in the field of the Crossroad Structure 202. It is clear that the extent of the field is a matter of choice, depending upon the particular design.

As explained before, the Full Traffic Light Regulator 208 manages the Crossroad Structure 202 activities (to keep traffic light process in step) in regard to the information provided by the Crossroad Supervisor 210.

The Crossroad Supervisor 210 is part of an Urban Coordinated Infrastructure, wherein changes in one traffic light imply a number of other traffic lights are to be changed all along the road network. By using the Crossroad Supervisor 210, the likelihood of damaging traffic flow across the urbanism area is therefore evaluated, and traffic light control is assessed with respect to the broader implications. To ensure that the urbanism road network is correctly re-synchronized, the Crossroad Supervisor 210 generates the correct re-synchronizing "sync_infra" signal to be provided to the Urbanism Infrastructure Coordinator 216.

Figure 3:
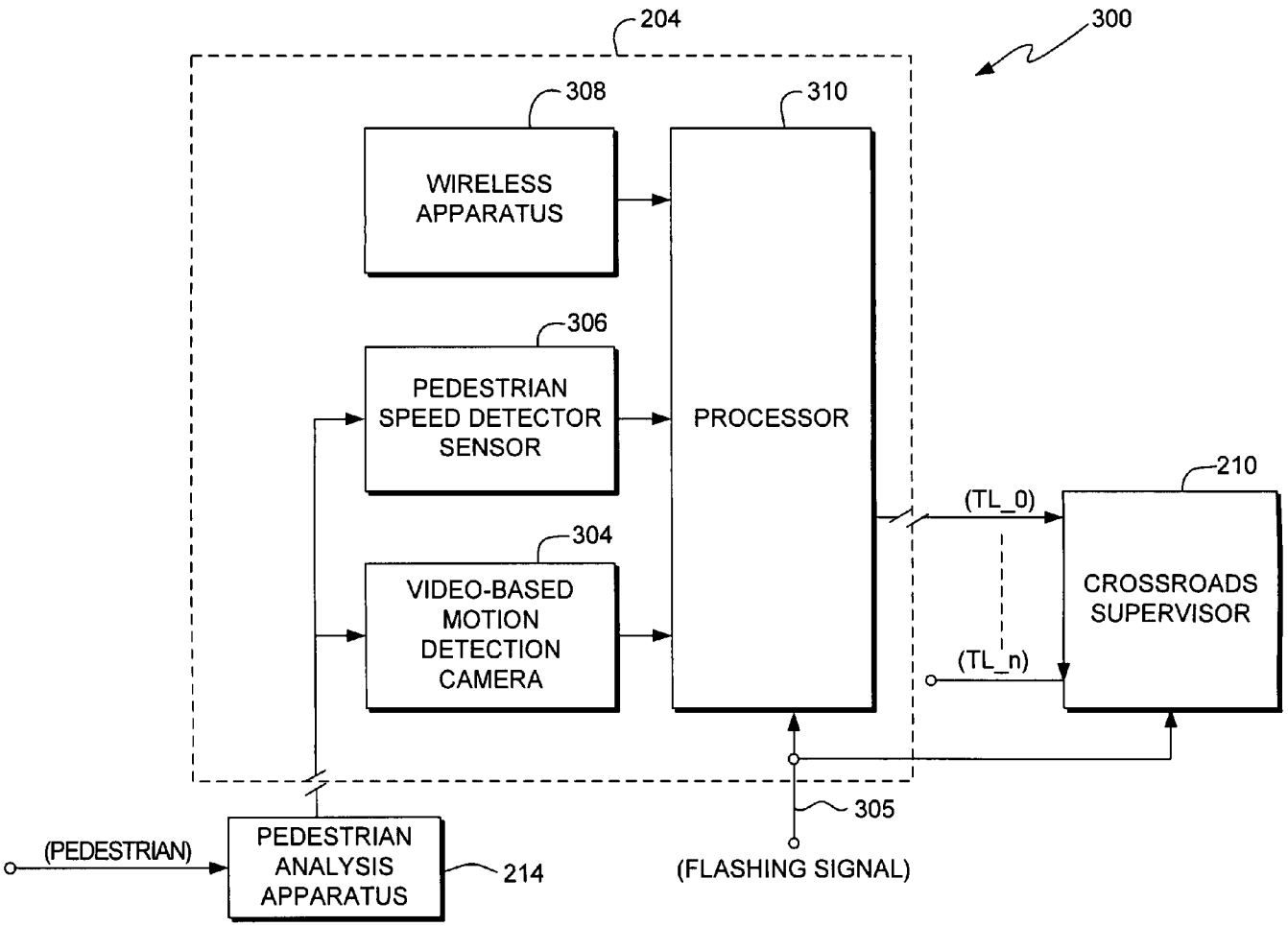
FIG. 3 shows one possible detailed arrangement of the Crosswalk Control Apparatus, as shown in FIG. 1 and FIG. 2.

FIG. 3 details the logic block diagram of the Crosswalk Control Apparatus 204 of FIG. 2. The Crosswalk System 300 of FIG. 3 comprises Pedestrian Analysis Apparatus 214 that catches, in real time, pedestrian information to be used by Crosswalk Control Apparatus 204. In FIG. 3, only one Crosswalk Control Apparatus 204 is considered but it is clear that a plurality of such apparatus may be employed in an integrated network.

Crosswalk Control Apparatus 204 is composed of Video-Based Motion Detection Camera 304, a Pedestrian Speed Detection Sensor 306, a Wireless Apparatus 308 for user preferences and Processor 310 for data processing which may be a local processor.

Crosswalk Control Apparatus 204 receives the "flashing signal" command on line 305, coming from the Full Traffic Light Regulator 208 in FIG. 2. This commond controls the flashing "walk/don't walk" signal apparatus (not shown here).

The Video-Based Motion Detection Camera 304 processes the images of the pedestrian physical movement identified by the Pedestrian Analysis Apparatus 302. The principle employed is based on trajectory analysis and detects motion, like pedestrian motion, within the field of view of the camera included in the Video-Based Motion Detection Camera 304. As an example, pedestrian images can be taken as the individual approaches the street corner.

It is important to mention that slow moving pedestrians symptoms are not exclusive conditions for people with disability of older people, and can be relevant conditions for people who take more than normal time to cross a street for whatever reasons. Accordingly, the present invention is directed to slow moving pedestrians for which the speed of motion is below the official "norm" or a standard threshold speed, as described above.

The Pedestrian Speed Detection Sensor 306 detects the speed and the direction of the pedestrian that moves within the field of view of the camera included in the Video-Based Motion Detection Camera 304 system.

As shown in FIG. 3, Wireless Apparatus 308 is arranged to directly receive user preferences by employing wireless technology. User identification and preferences data is sent to Processor 310. The user's identification and preferences data are previously stored in memory using smart card technology (not shown here). The data is automatically transmitted on user request. For example, the user's preferences may contain personal information related to pedestrian speed of motion or vision. Thus, Wireless Apparatus 308 for user preferences might allow pedestrians to preset their individual cross walking time duration without the need for speed detection by the detection devices 304 and 306.

Both the Video-Based Motion Detection Camera 304 and the Pedestrian Speed Detection Sensor 306 form an efficient auto-detection motion mechanism based, for example, on biometrics technology that provides the real time data that Processor 310 requires to control Crosswalk Supervision 210. The Video-Based Motor Detection Camera and the Pedestrian Speed Detection Sensor are detection apparatus known in the art. However, other known apparatus used in biometrics technology and, in particular, biometrics as relates to walking speed and gait may readily be employed.

In this regard, biometrics technology has been described in a plethora of documents and articles that may readily be found, for example, through the internet. Much of this technology is directed to biometrics as relates to various ways of implementing detection apparatus and processes for determining individual walking speed and gait and determining a standard for such characteristics. These processes typically use standard methods of signal/image processing, quantization, and the like.

A series of Crosswalk Control Apparatus for controlling traffic lights can provide data to Processor 310 resulting in the output computation of TL_o up to TL_n which is sent to the Crossroad Supervisor 210, as shown in FIG. 3. In this regard, the TL_o to TL_n data signals include information in regard to pedestrian location and speed. Crossroad Supervisor 310 then determines the time required for a given slow moving pedestrian to traverse a set distance and initiates correct control signals for Full Traffic Light Regulator 208, as shown in FIG. 2. The Crossroad Supervisor thus carries out an algorithm (see FIG. 5) to resolve crosswalk contention based upon pedestrian and vehicle speeds and location, and provides appropriate control signals to control traffic lights conditions and their timing accordingly. In this regard, there are a variety of ways to control traffic lights, one of which is described in U.S. Pat. No. 6,724,320 assigned to the Assignee of the present invention.

A typical traffic light regulation arrangement consists of one or more traffic lights, one being placed closely to the pedestrian, another one located to the opposite corner and other ones located at the adjacent corners.

Figure 4:
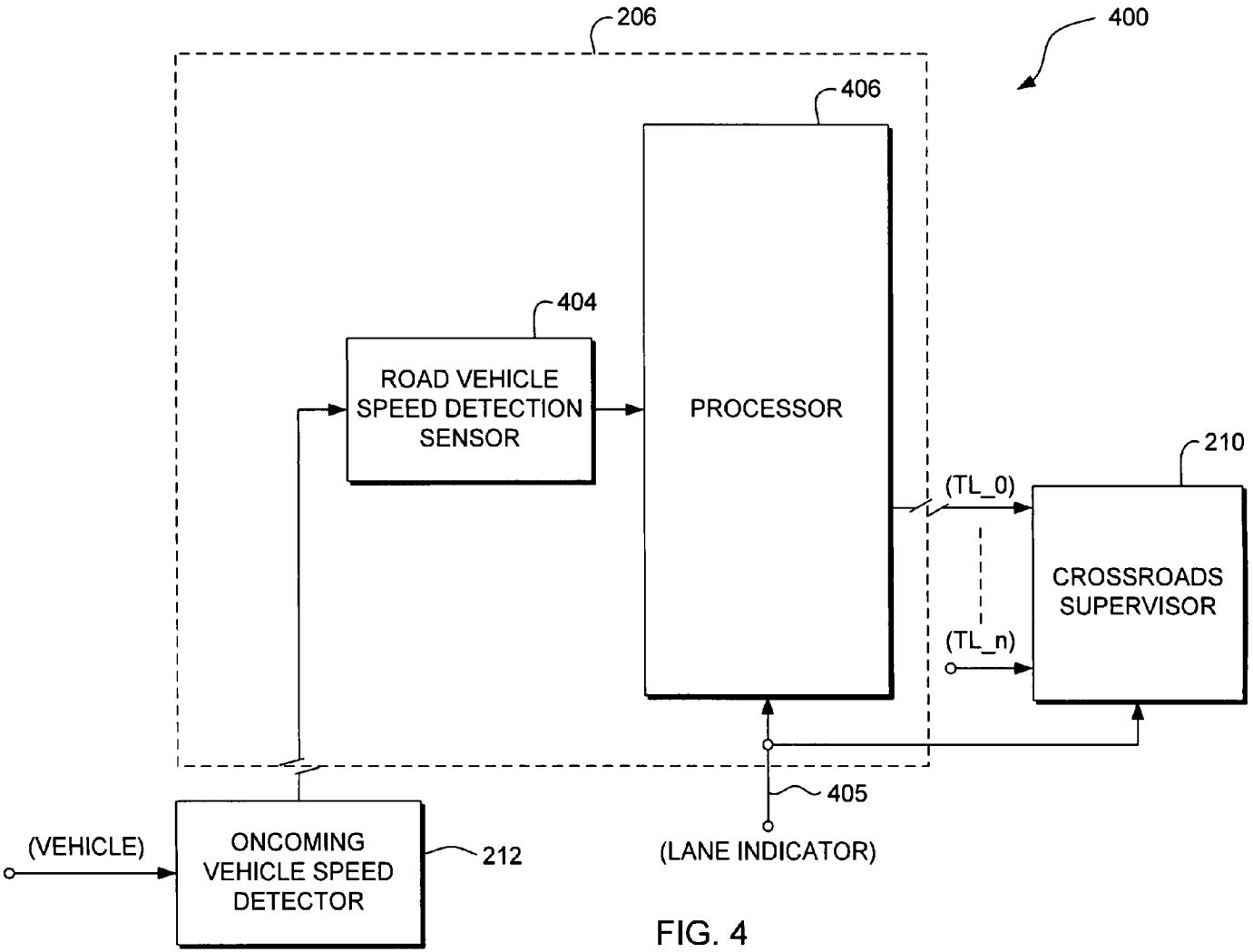
FIG. 4 shows one possible detailed arrangement of Road Network Control Apparatus, as shown in FIG. 1 and FIG. 2.

FIG. 4 details a block diagram system arrangement 400 that includes the Road Network Control Apparatus 206, as shown in FIG. 2. Road Network Control Apparatus 206 receives the oncoming car speed from Oncoming Vehicle Speed Detector 212, which detector captures the presence and real time speed of the vehicles within its capture field. In FIG. 4, only one Road Network Control Apparatus 206 is shown but it is clear that a plurality of such apparatus may be used.

The Road Network Traffic Control Apparatus 206 includes a Road Vehicle Speed Detection Sensor 404 and a Processor 406 for processing information as to vehicle speed and location, signal status, and the like. In this regard, Road Network Traffic Control Apparatus 206 receives a "lane indicator" status command on input line 405 coming from the Full Traffic Light Regulator 208 in FIG. 2 which gives an adjacent lane "stop" command when traffic requirements dictate an overriding necessity to stop traffic in the lane adjacent the pedestrian. The adjacent lane stop indicator is not shown in FIG. 4.

The Road Vehicle Speed Detection Sensor 404 determines the real time speed of the vehicles that are detected within the field of the Crosswalk Structure (FIG. 2, 108) and feeds the speed information to data Processor 406.

A series of Road Network Traffic Control Apparatus 206 may be placed all along the road network and transmit resulting data computation (TCP_O up to TCP-n) from Processor 406, to the Crossroad Supervisor 210. Then, Crossroad Supervisor 210 sends signals to Full Traffic Light Regulator 208, in FIG. 2, which regulator initiates the required actions in regard to the crossroad/crosswalk events.

Returning now to FIG. 2 in conjunction with the accompanying FIG. 3 and FIG. 4, assume a vehicle on the road network approaches Crossroad and Crosswalk Structure 108 when a slow moving pedestrian gains permission to cross the road via the "flashing walk" command typically used at intersections. At that point, Crosswalk Control Apparatus 204 has already determined the pedestrians walking speed and sent it to Processor 310 which, in turn, processes the speed information and sends control signals to Crossroad Supervisor 210. In this regard, the Pedestrian Speed Detection Sensor 306 detects both the real time speed and direction of the pedestrian that moves within the field of view of the camera included in the Video-Based Motion Detection Camera 304.

At the same time, the Road Vehicle Speed Detection Sensor 404 detects the real time speed of oncoming vehicles in the area of the crosswalk.

Processor 406 processes the speed data from the Road-Vehicle Speed Detection Sensor 404 and transmits same to Crossroad Supervisor 210. Crossroad Supervisor 210 compares the data originating from the pedestrian with those coming from the oncoming vehicles and determines the level of risk of collision between pedestrian and vehicle and initiates required action to the corresponding traffic lights, as arranged in the Crossroad and Crosswalk Structure 202. Detection of high level of risk of collision initiates signals to cause the appropriate traffic lights to switch from a green light to "stop" light position.

Where a moderate level of risk is of collision involved in crossing the road, the timing duration of "flashing walk/don't walk" and the status of vehicle traffic lights are adjusted to respond to the pedestrian walking speed as previously defined. Again, this allows slow moving pedestrian to cross the street safely. It is clear that, in addition to pedestrian walking speed, the width of the street or road is factored into controlling the time duration of "flashing walk/don't walk and vehicle traffic light status.

Depending of the width of the street, the intersection configuration and the crossroad traffic, Crossroad Supervisor 210 acts to segment the crosswalk process in two or more crosswalk sub-processes that allow slow moving pedestrians to safely cross the street in a two or more step approach. Each crosswalk sub-process is associated with a unique traffic lane direction in which individual modification of traffic patterns may be applied.

In this regard, the traffic lights associated with each crosswalk sub-process is asynchronous. Crossroad Supervisor 210 in FIG. 2 monitors each of them independently in regards to the walking speed identification of the pedestrian. The crosswalk sub-processes manages both the vehicle traffic and the pedestrian traffic that are in the area of the selected crosswalk lane segment. Such crosswalk subprocesses are particularly applicable when the street is very wide.

An extension of the present invention is to employ smart card technology or similar technology in which is stored the pedestrian user's preferences. The information stored in the smart card is automatically identified using the wireless technology. This is shown by Wireless Apparatus block 308 in FIG. 3. Wireless Apparatus 308 receives the user's preferences data which is processed by Processor 310. This feature allows a pedestrian to request street crossing by using some preset preferences that were previously stored in the memory of the smart card. Once granted by the Crossroad Supervisor 210, the pedestrian may cross the street using the pedestrian's individual required crosswalk time duration.

Figure 5A:
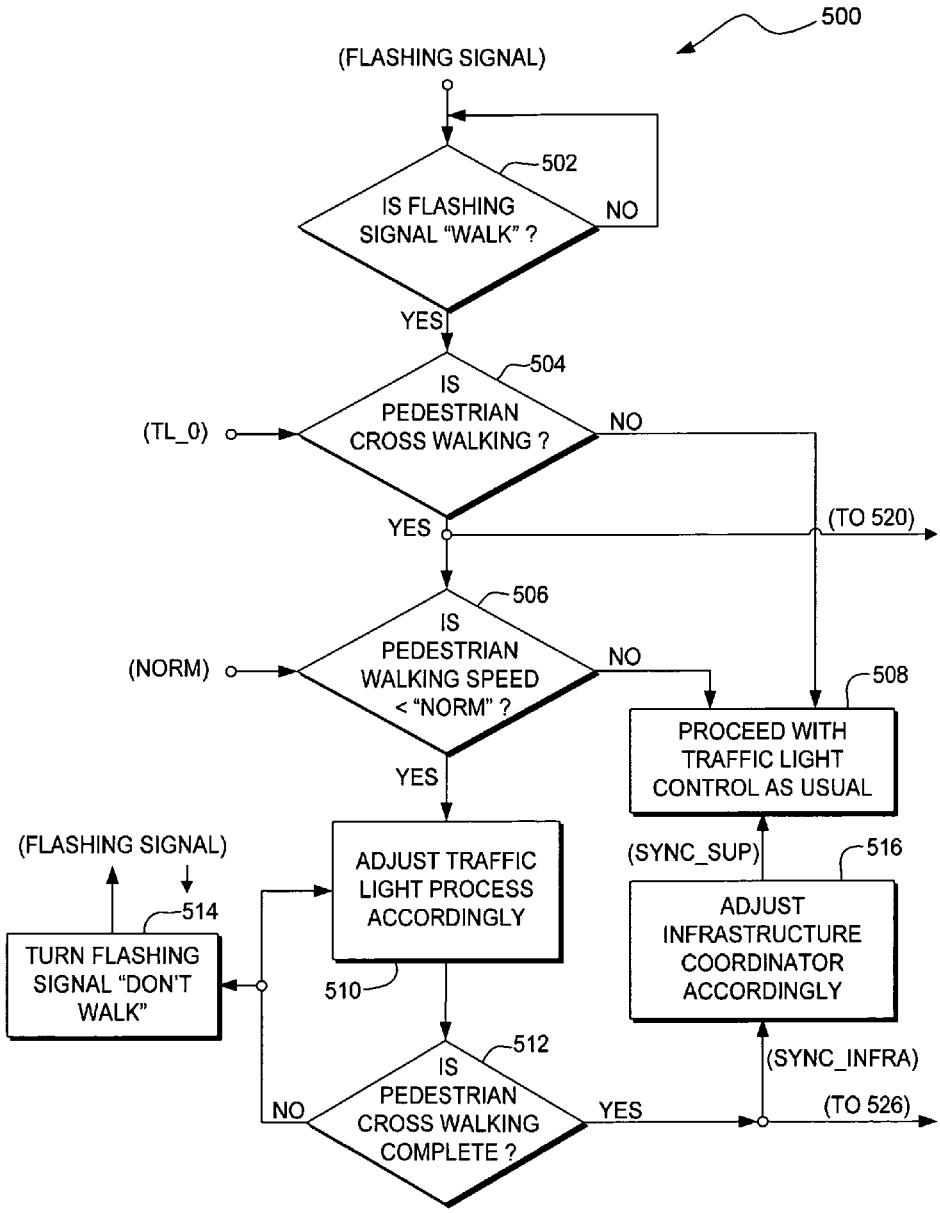
FIGS. 5A and 5B is a flow chart illustrating the automatic traffic light adjustment process.
Figure 5B:
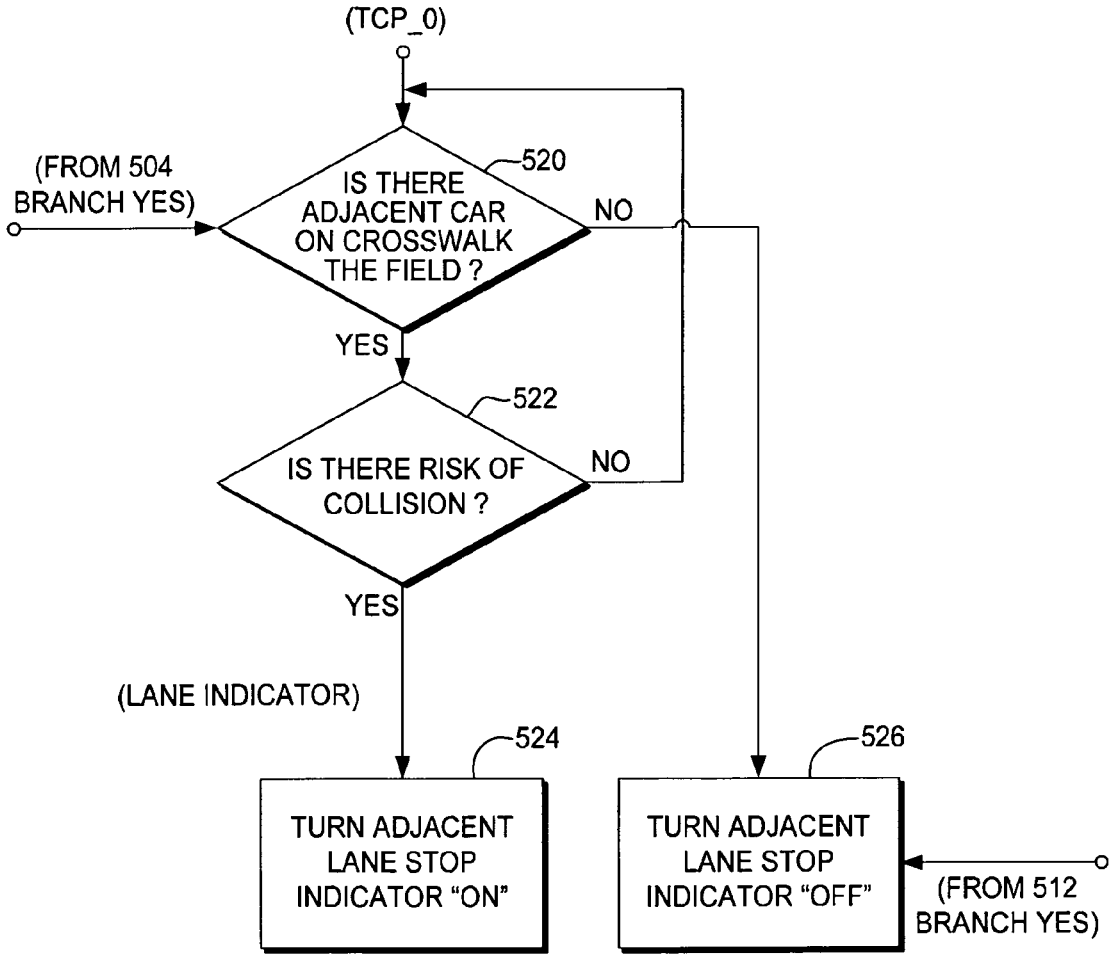

With reference to FIG. 5*a* and 5*b*, a flow chart 500 is shown representing the traffic control process. A series of comparisons in FIG. 5*a* begin the process with the "flashing signal" input to "Flashing Walk"/Don't Walk signal" query of block 502. This query of 502 checks whether the pedestrian has permission to cross the street or not. This is done by sampling the state of the "flashing signal" command. Once the "flashing signal" command has been detected as "Walk" (branch Yes of step 502), the process begins.

The query of step 504 (Is pedestrian cross walking?) detects the pedestrian cross-walking events given by the combination of signals "TL_O up to TL_n" (only TL_O is shown). All "TL" signals originate from the Pedestrian Analysis Apparatus 214, shown in FIG. 2. When the cross-walking condition is met (branch Yes of comparator 504), the walking speed of the pedestrian, as determined by Crosswalk Control Apparatus 204 in FIGS. 2 and 3, is compared to the Official Traffic Light Norm Duration stored storage device 218 in FIG. 2. This is shown in step 506. Where the pedestrian walking speed is not less than normal, traffic light regulation maintains the original timing as defined by step 508 to "Proceed With Traffic Light Control As Usual".

Where step 504 determines there is a pedestrian cross walking, the process is divided in two actions that work simultaneously. The first action is entering into step 506 as described above. The second action is to determine whether any pedestrian crossing the street has a potential risk of having collision with any oncoming car that is in the crosswalk field independent of the question of pedestrian speed. To determine if a risk exists, the process branches to the query of step 520 "Is there adjacent car on the crosswalk field?" shown in FIG. 5*b*.

Step 520 in FIG. 5*b* evaluates the speed of the adjacent vehicles given by the combination of "TCP_O up to TCP_n" signals from Road Network Control Apparatus 206 shown in FIG. 2. All "TCP" signals originate from Oncoming Vehicle Speed Detector 212 in FIG. 2. An oncoming vehicle that is in the field of the Crossroad and Crosswalk Structure and, more particularly, at the adjacent corner of the crosswalk section, is a good candidate to be checked in step 520. Step 520 continues to loop back until, the detection of any oncoming vehicle within the field of the crosswalk occurs. With the detection of an oncoming vehicle within the field of the crosswalk, the query of step 522 "Is there risk of collision?" is initiated.

Step 522 computes the likelihood that the detected vehicle will collide with the pedestrian in the crosswalk. In the present invention, the collision risk is computed based upon whether the vehicle approaching from the adjacent corner exceeds the speed limit as determined by the Road Network Control Apparatus 206 in FIG. 2. The computation determines the worst case required distance to stop before colliding with pedestrian. The distance between the vehicle and pedestrian is determined using the data provided by the Oncoming Vehicle Speed Detector 212 in FIG. 2. If there is a risk of collision, then the process goes to step 524 (branch Yes of block 522) to initiate a command to turn on the "lane stop indicator" of the vehicle traffic signal to stop vehicle traffic. Where there is no risk of collision, the process loops back to step 520 to initiate the process of again checking if there is an adjacent vehicle in the crosswalk. The "lane stop indicator" command acts, in particular, to "Turn adjacent lane stop indicator ON" as shown in process step 524. Where there is no adjacent car in the crosswalk field as determined by step 520, the process goes to step 526 to initiate the "Turn adjacent lane stop indicator OFF" process.

Where step 526 acts to reset the "adjacent lane stop indicator" to off, it is clear that there exists no risk of collision because the distance between the car and pedestrian is sufficient to stop as determined by step 522. The process of step 526 is also initiated when the pedestrian crossing the crosswalk is out of the crosswalk, as detected in step 512 in FIG. 5*a* using the re-synchronizing "sync_infra" signal.

The adjacent lane stop road indicator signal structure (not shown in FIG. 5) is positioned near to the crosswalk. The adjacent lane stop road indicator signal structure is enabled by using the "lane indicator" command from step 522. Initiating the "ON" "lane indicator" command acts to signal the driver to stop thereby avoiding the risk of collision on the crosswalk. The indicator stays "ON" until the pedestrian crossing the street is out of the crosswalk.

Step 506 (Is pedestrian walking speed <"norm" ?) in FIG. 5*a* compares the pedestrian speed of motion or walking speed to the "norm" threshold that is defined by the "Official traffic light norm duration" stored in storage device 218 in FIG. 2.

Where the pedestrian walking speed is below the "norm", traffic light timing control is adjusted accordingly and, to do this, the "Adjust traffic light process accordingly" step is carried out, as represented by block step 510. In the case of matching the "norm", the traffic light regulation maintains the original process as defined in the "Proceed traffic light as usual of step 508.

Once the "Adjust traffic light process accordingly" of step 510 has been initiated, the pedestrian's cross walking position is monitored all along the crosswalk.

As can be seen, step 512 (Is pedestrian cross walking complete?) determines the pedestrian position as the pedestrian is slowly moving all along the crosswalk, and evaluates the pedestrian distance left to the destination crosswalk spot. Step 512 loops back to step 510 until the completion of the pedestrian cross walking occurs at branch "Yes" of query 512.

When the pedestrian is still cross-walking, the "flashing signal" command swaps from the "walk" to "don't walk" position enabling the turn on flashing signal "don't walk" step 514. The flashing signal "don't walk" informs pedestrians that no additional pedestrians are authorized to cross the street or road in the current cycle. Enabling the flashing signal to the "don't walk" position reduces the additional cross walking delay that potentially deteriorates the global urban traffic light regulation system.

Once the completion of a pedestrian cross walking is detected as given by "branch Yes of query 512, the urbanism road network is readjusted to minimize the impact due to the additional slow moving pedestrian delay. The re-synchronizing "sync_infra" signal is applied to the "Adjust Infrastructure Coordinator accordingly" process step 516 that initiates instructions to the Urbanism Infrastructure Coordinator 216 of FIG. 2.

Finally, in step 516, the "Adjust Infrastructure Coordinator accordingly" process acknowledges the re-synchronous action by using the "sync_sup" signal that initiates the original "Proceed with traffic light control as usual process" step of block 508.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and explanation, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method comprising:

obtaining personal data relative to a pedestrian crossing an intersection, said personal data including at least walking speed of said pedestrian;

obtaining current speed of at least one vehicle approaching the intersection;

processing said personal data and the current speed of said at least one vehicle to create at least one cross walk indicator; and adjusting a traffic light according to the value of said at least one cross walk indicator.

2. The method of claim 1 wherein the step of processing said personal data of said pedestrian comprises the step of comparing the said walking speed of said pedestrian to a standard normal walking speed value.

3. The method of claim 2 wherein the step of processing said current speed of said at least one vehicle comprises the step of comparing said current speed to a threshold vehicle speed value.

4. The method of claim 3 wherein said at least one cross walk indicator comprises a signal indicative of a slow moving pedestrian and the said step of adjusting the traffic light further comprises the step of adjusting the time duration of a "walk" signal of said traffic light according to the walking speed of said slow moving pedestrian.

5. The method of claim 1 wherein the at least one cross walk indicator comprises a signal indicative of a risk of collision between the said at least one vehicle and said pedestrian, and wherein said step of adjusting said traffic light comprises generating a Stop signal to warn said at least one vehicle to stop.

6. The method of claim 1, wherein the step of acquiring personal data further comprises the step of receiving wireless personal data relative to said pedestrian.

7. The method of claim 4 further comprising the step of determining whether the crossing of said intersection by said pedestrian is complete, and further comprising the step of maintaining said time duration until said pedestrian completes crossing said intersection.

8. The method of claim 3 wherein when said current speed of said at least one vehicle exceeds said threshold vehicle speed value, a vehicle "stop" signal is generated.

9. A system, comprising:

detection apparatus for obtaining personal data relative to at least one pedestrian crossing an intersection, said personal data including at least walking speed of said pedestrian;

detection apparatus for obtaining the current speed of at least one vehicle approaching said intersection;

data processing apparatus for processing said personal data relative to the walking speed of said at least one pedestrian crossing said intersection and said current vehicle speed of said at least one vehicle approaching said intersection to generate traffic control signals; and a traffic light regulator for sending said traffic control signals to a traffic light to control vehicle and pedestrian traffic in accordance with pedestrian and vehicle traffic speed.

10. The system of claim 9 wherein said date processing apparatus compares the walking speed value of said at least one pedestrian crossing said intersection to a stored standard normal walking speed value and generates a traffic control time duration signal value in accordance with the difference between said pedestrian walking speed value and said standard normal walking speed value where said pedestrian walking speed value is less than said walking speed value.

11. The system of claim 9, wherein said data processing apparatus compares said current vehicle speed value of said at least one vehicle approaching said intersection to a threshold vehicle speed value.

12. The system of claim 10 wherein said time duration value is sent to said traffic control regulator to control the time duration of the "walk" condition of said traffic light.

13. The system of claim 9 wherein said traffic control signals include a risk signal representing the risk of collision between said at least one vehicle and said at least one pedestrian crossing said intersection with said risk signal sent to said traffic control regulator to enable the "stop" condition of said traffic light for said at least one vehicle.

14. The system of claim 9 including wireless communication apparatus for transmitting data to said data processing apparatus.

15. A computer program product for controlling a traffic light, said computer program product comprising:

a computer readable storage medium having computer readable program code embodied therewith, the computer readable program code comprising;

a first program instruction to access personal data in said relative to a pedestrian crossing an intersection, said personal data including at least walking speed of said pedestrian;

a second program instruction to access the current speed in said of at least one vehicle approaching said intersection;

a third program instruction to process said personal data and said current speed of said at least one vehicle to generate traffic control decisions and;

a fourth program instruction acting to generate traffic light control instructions according to said traffic control decisions.

16. The computer program product of claim 15 including a program instruction stored on said computer readable storage medium to compare said walking speed value of said pedestrian to a standard normal walking speed value and produce traffic control decisions based upon a time duration value difference when the said walking speed value of said pedestrian is different than said standard normal walking speed value.

17. The computer program product of claim 16 including a program instruction stored on said computer readable storage medium to compare said current speed of said at least one vehicle to a threshold vehicle speed value.

18. The computer program product of claim 17, including a program instruction stored on said computer readable storage medium to apply said time duration value difference of said traffic control decisions to adjust the time duration of a "walk" condition of a traffic light control instruction.

19. The computer program product of claim 18 including a program instruction stored on said computer readable storage medium to generate a risk value indicator representing the risk of a collision based upon said current speed of said at least one vehicle and said walking speed of said pedestrian and generate a traffic light control instruction that will be used to enable a "stop" signal to warm said at least one vehicle to stop when said risk value indicates possible collision between said vehicle and pedestrian.

20. The computer program product of claim 19 including a program instruction stored on said computer readable storage medium that will act to store and process personal data received from wireless apparatus.

* * * * *

UNITED STATES PATENT AND TRADEMARK OFFICE

CERTIFICATE OF CORRECTION

PATENT NO. : 7,864,072 B2
APPLICATION NO. : 12/140543
DATED : January 4, 2011
INVENTOR(S) : Sara H. Basson et al.

It is certified that error appears in the above-identified patent and that said Letters Patent is hereby corrected as shown below:

On the Title Page insert

--(30) Foreign Application Priority Data

Nov. 11, 2007 (EP) ..... 07301541--

Signed and Sealed this
Third Day of September, 2013

Teresa Stanek Rea
*Acting Director of the United States Patent and Trademark Office*